US006470852B1

(12) United States Patent
Kanno

(10) Patent No.: US 6,470,852 B1
(45) Date of Patent: Oct. 29, 2002

(54) ENGINE CONTROL SYSTEM

(75) Inventor: Isao Kanno, Shizuoka (JP)

(73) Assignee: Sanshin Kogyo Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/626,868

(22) Filed: Jul. 27, 2000

(30) Foreign Application Priority Data

Jul. 27, 1999 (JP) ..... 11-212826

(51) Int. Cl.[7] ..... F02D 41/16
(52) U.S. Cl. ..... 123/339.23; 123/339.11
(58) Field of Search ..... 123/339.23, 339.11

(56) References Cited

U.S. PATENT DOCUMENTS

| | | | | | |
|---|---|---|---|---|---|
| 4,726,798 | A | | 2/1988 | Davis | |
| 4,827,885 | A | * | 5/1989 | Nishikawa | 123/339.11 |
| 4,843,914 | A | | 7/1989 | Koike | |
| 4,903,662 | A | | 2/1990 | Hirukawa et al. | |
| 4,930,475 | A | * | 6/1990 | Daikoku et al. | 123/339.11 |
| 4,966,115 | A | | 10/1990 | Ito et al. | |
| 5,062,401 | A | | 11/1991 | Suganuma | |
| 5,072,629 | A | | 12/1991 | Hirukawa et al. | |
| 5,117,792 | A | | 6/1992 | Kanno | |
| 5,136,279 | A | | 8/1992 | Kanno | |
| 5,153,446 | A | * | 10/1992 | Shimomura | 123/339.23 |
| 5,213,076 | A | * | 5/1993 | Umemoto et al. | 123/339.23 |
| 5,261,368 | A | * | 11/1993 | Umemoto | 123/339.23 |
| 5,403,246 | A | | 4/1995 | Umemoto | |
| 5,450,828 | A | * | 9/1995 | Sakamoto et al. | 123/339.11 |
| 5,584,266 | A | | 12/1996 | Motose et al. | |
| 5,645,032 | A | | 7/1997 | Motose | |
| 5,669,349 | A | | 9/1997 | Iwata et al. | |
| 5,697,337 | A | * | 12/1997 | Takahashi et al. | 123/339.11 |
| 5,827,150 | A | | 10/1998 | Mukumoto | |
| 5,970,951 | A | | 10/1999 | Ito | |
| 6,109,235 | A | * | 8/2000 | Hoshiba et al. | 123/339.11 |
| 6,119,653 | A | * | 9/2000 | Morikami | 123/339.23 |

FOREIGN PATENT DOCUMENTS

| | | |
|---|---|---|
| JP | 4-12139 | 1/1992 |

* cited by examiner

*Primary Examiner*—Erick Solis
(74) *Attorney, Agent, or Firm*—Knobbe, Martens, Olson & Bear, LLP

(57) ABSTRACT

An engine control system includes an improved construction that can release an engine from an abnormal engine speed so that, for example, the operator can operate a shift actuator without any overload. The engine includes an air induction system that introduces air to the combustion chamber and includes a throttle valve. The throttle valve admits the air to flow through the air induction system unless placed in a closed position. A throttle valve position sensor is arranged to sense the position of the throttle valve. An engine speed sensor is also arranged to sense a rotational speed of the crankshaft. A control device is provided for slowing down the engine speed based upon a throttle position signal from the throttle valve position sensor and a speed signal from the engine speed sensor. In one operating mode, the slow down control is made when the throttle position signal indicates that the throttle valve is generally at the closed position and the speed signal indicates that the engine speed exceeds a preset speed.

38 Claims, 5 Drawing Sheets

ENGINE CONTROL SYSTEM

PRIORITY INFORMATION

This invention is based on and claims priority to Japanese Patent Application No. Hei 11-212826, filed Jul. 27, 1999, the entire contents of which is hereby expressly incorporated by reference.

BACKGROUND OF THE INVENTION

1. Field of the Invention

This invention relates to an engine control system, and more particularly to an improved engine control system that controls an idle engine speed.

2. Description of Related Art

A typical engine has an air induction system that introduces air to a combustion chamber of the engine. A throttle valve normally controls the amount of the air delivered. The throttle valve is disposed in an air intake passage and is arranged to move between an open position and a closed position. When the throttle valve is in the closed position, generally no air is supplied to the combustion chamber. A typical engine also has an idle passage that bypasses the throttle valve for delivering a nominal amount of air for maintaining an idle speed.

Fuel is delivered to the combustion chamber through a charge forming device (e.g., a carburetor or a fuel injection device). The amount of fuel is normally controlled to be proportional to the air amount. The air and the fuel are mixed to form an air/fuel charge. The air/fuel charge is then fired at a proper ignition timing for combustion in the combustion chamber The ignition timing is normally controlled by a control device so as to be advanced or retarded from an initial timing in response to various engine running conditions.

In some instances, however, a relatively large amount of air can be continuously supplied to the combustion chamber even though the throttle valve is fully closed. Under this condition, the engine speed exceeds a desired idle speed and the engine operates at speed greater than the desired idle speed unless the operator stops the engine. This abnormal condition can occur, for example, if the throttle valve is broken or bent. The same situation can also occur if the ignition timing is inadvertently advanced.

This situation poses a problem with an engine for a marine propulsion unit such as, for example, an outboard motor. The outboard motor includes an engine and a propulsion device such as, for example, a propeller. A forward, neutral, reverse transmission couples them so as to transmit power of the engine to the propeller and also to shift or switchover the rotational direction of the propeller into one of the forward, neutral and reverse operating conditions.

The transmission typically includes a bevel gear train and a clutch mechanism. The bevel gear train comprises a drive gear connected to a driveshaft, which is driven by an output shaft of the engine, and forward and reverse bevel gears both connected to a propeller shaft at an end portion of which the propeller is mounted. The clutch mechanism selectively couples the propeller shaft with the forward or reverse bevel gear. Both of the bevel gears are engaged with the drive gear but are not drivingly connected to the propeller shaft until coupled together by the clutch mechanism. Each bevel gear has fixed dog clutch teeth, while the propeller shaft has moveable dog clutch teeth. The power transmittable connection is completed when the fixed dog clutch teeth and the moveable dog clutch teeth are coupled with each other. The moveable dog clutch teeth are slideably supported on the propeller shaft and can be moved by a shift actuator.

The operator may operate the shift actuator so as to selectively engage the moveable dog clutch teeth with the fixed dog clutch teeth on the forward bevel gear or the reverse bevel gear, or not engage them with each other. When the propeller shaft is coupled with the forward bevel gear through that connection, the propeller rotates in the forward direction. When it is coupled with the reverse bevel gear, the propeller rotates in the reverse direction.

Normally the shift operations are made under a low engine speed condition, i.e., an idle speed, to easy separation of and engagement between the dog clutch teeth. That is, the operator slows down the engine speed first and then operates the shift actuator. If, however, the engine maintains a speed above a desired idle speed, the engine speed will not reduce to the desired idle speed and the shift operation will be extremely difficult. If this problem occurs, the operator will have difficulty docking the associated watercraft at a desired position. Moreover, the operator will have difficulty establishing a forward or reverse drive condition from neutral.

A need therefore exists for an improved engine control system that can release an engine from an abnormal engine speed so that, for example, the operator can operate a shift actuator without overload.

SUMMARY OF THE INVENTION

In accordance with one aspect of the present invention, an internal combustion engine comprises a cylinder body defines at least one cylinder bore in which a piston reciprocates to rotate a crankshaft. A cylinder head is affixed to an end of the cylinder body and defines a combustion chamber with the cylinder bore and the piston. An air induction system is arranged to introduce air to the combustion chamber. The air induction system includes a throttle valve movable between an open position and a closed position. The throttle valve regulates air flow through the air induction system. A throttle valve position sensor is arranged to sense the position of the throttle valve. An engine speed sensor is arranged to sense a rotational speed of the crankshaft. A control device is configured to slow down the rotational speed of the crankshaft, based upon a throttle position signal from the throttle valve position sensor and an engine speed signal from the engine speed sensor, when the throttle position signal indicates that the throttle valve is generally at the closed position and the speed signal indicates that the rotational speed of the crankshaft exceeds a preset speed.

In accordance with another aspect of the present invention, a marine propulsion unit comprises an internal combustion engine, a transmission device, and a propulsion device for propelling the propulsion unit. The transmission device is arranged to transmit engine power to the propulsion device. The transmission device is also adapted to establish a forward, neutral and reverse drive condition for the propulsion device. A shift position sensor is arranged to sense the drive condition. The internal combustion engine includes a cylinder body defines at least one cylinder bore in which a piston reciprocates to rotate a crankshaft. A cylinder head is affixed to an end of the cylinder body and defines a combustion chamber with the cylinder bore and the piston. An air induction system is arranged to introduce air to the combustion chamber. The air induction system includes a throttle valve that is movable between an open position and a closed position. The throttle valve regulates air flow through the air induction system. A throttle valve position sensor is arranged to sense the position of the throttle valve. An engine speed sensor is arranged to sense a rotational speed of the crankshaft. A control device is configured to slow down the rotational speed of the crankshaft, based upon a shift position signal from the shift position sensor, a throttle position signal from the throttle valve position sensor and a speed signal from the engine speed sensor, when the shift position signal indicates that the propulsion device is operating under one of the forward and reverse drive conditions, the throttle position signal indicates that the throttle valve is generally in the closed position, and the speed signal indicates that the engine speed exceeds a preset speed.

In accordance with a further aspect of the present invention, a method of controlling an internal combustion engine is provided. The engine has a crankshaft and an air induction system including a throttle valve. The method comprises sensing a position of the throttle valve, sensing a rotational speed of the crankshaft, and slowing down the rotational speed of the crankshaft if the throttle valve is generally placed at a closed position and the rotational speed exceeds a preset speed.

Further aspects, features and advantages of this invention will become apparent from the detailed description of the preferred embodiment which follows.

BRIEF DESCRIPTION OF THE DRAWINGS

These and other features of this invention will now be described with reference to the drawings of a preferred embodiment which is intended to illustrate and not to limit the invention. The drawings contain the following figures.

DETAILED DESCRIPTION OF THE PREFERRED EMBODIMENT OF THE INVENTION

Figure 1:
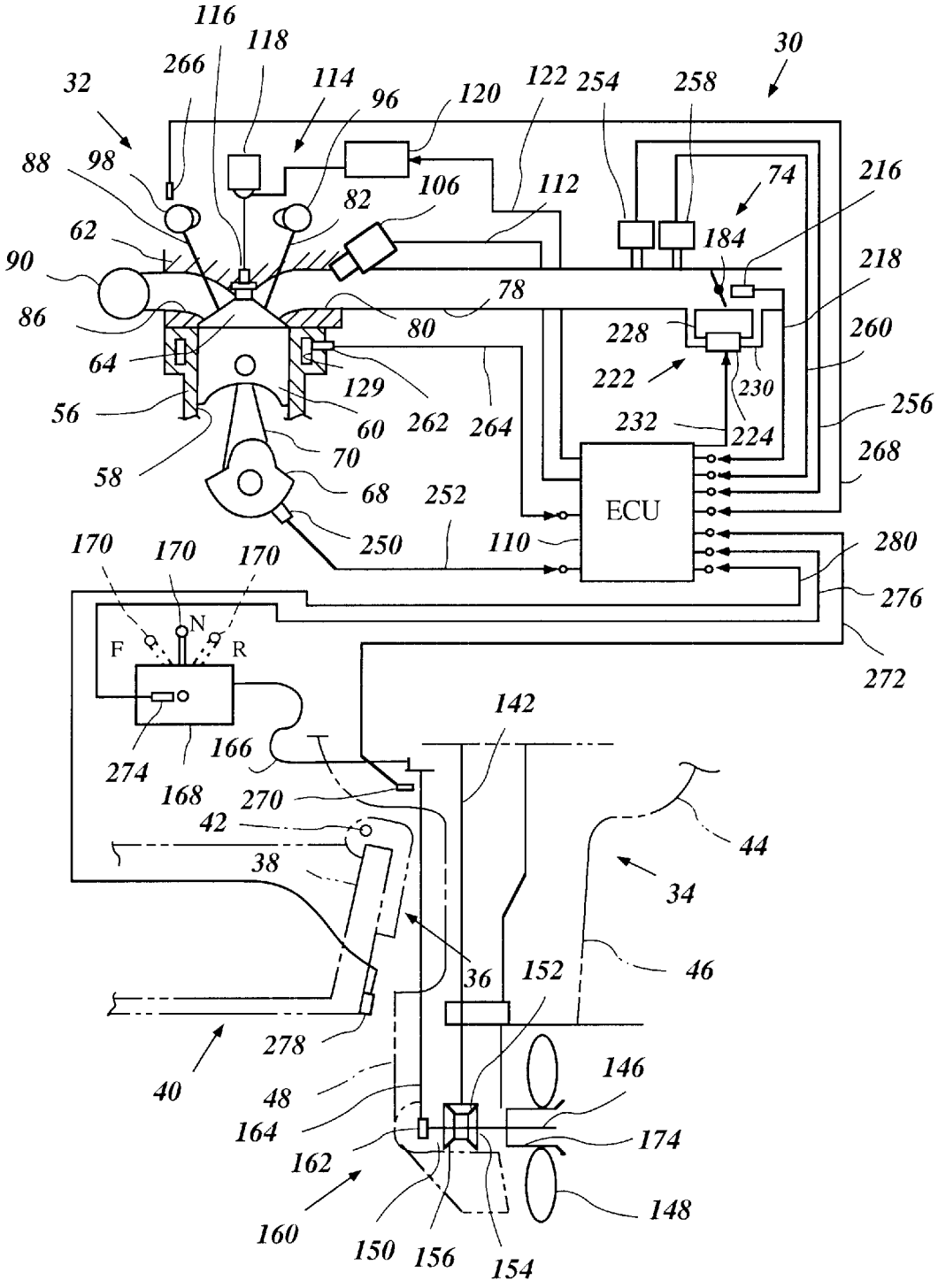
FIG. 1 is a schematic view of an outboard motor configured in accordance with a preferred embodiment of the present invention. An engine in part and a control device are shown in the upper half view of the figure. The outboard motor in part with a forward, neutral, reverse transmission device, a shift actuator and an associated watercraft are shown in the lower half view of the figure. An ECU links together the respective half views. The outboard motor and the associated watercraft are partially illustrated in phantom.
Figure 2:
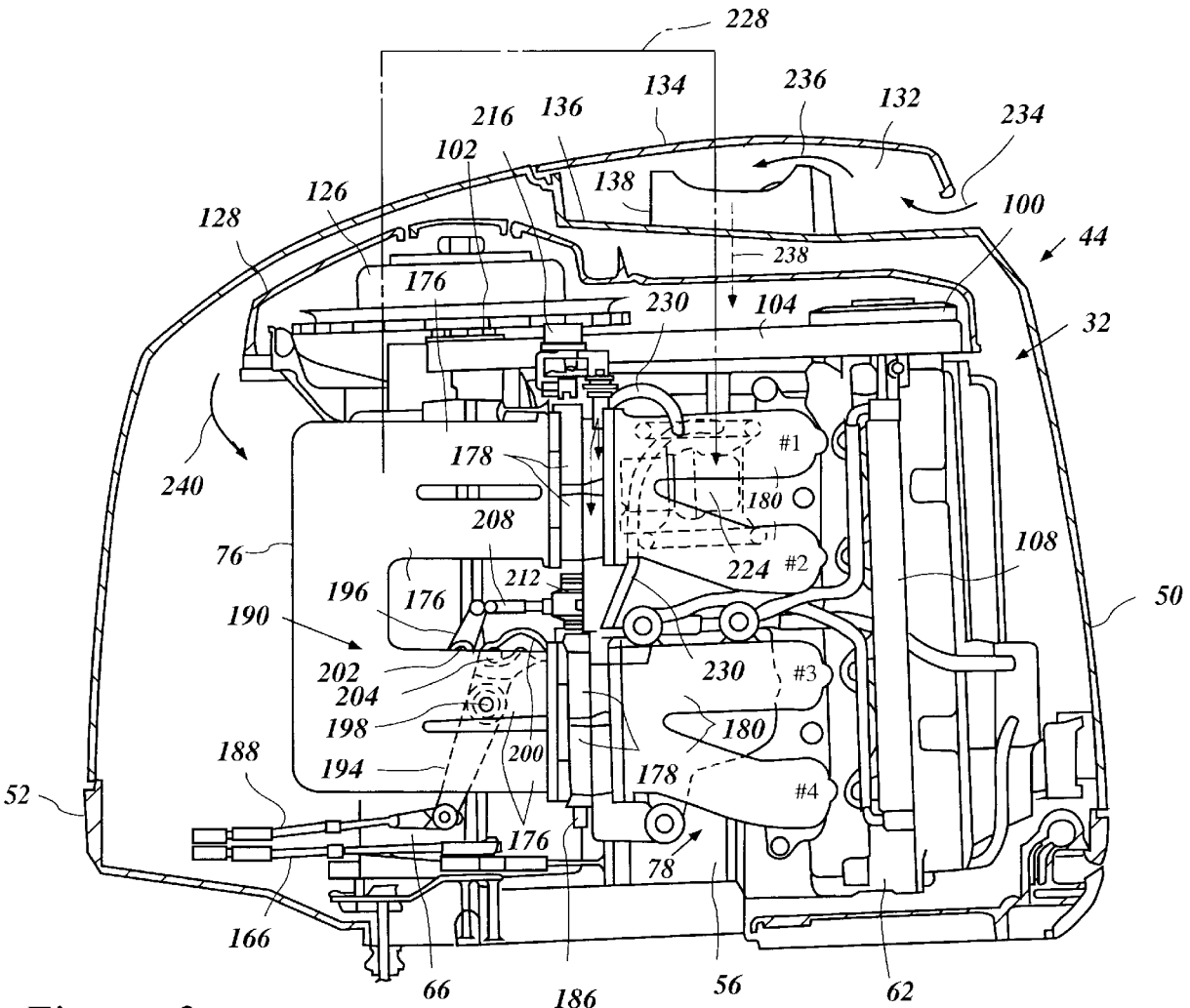
FIG. 2 is an elevational side view of the outboard motor. Specifically, its power head incorporates the engine. Top and bottom protective cowlings are shown in section.
Figure 3:
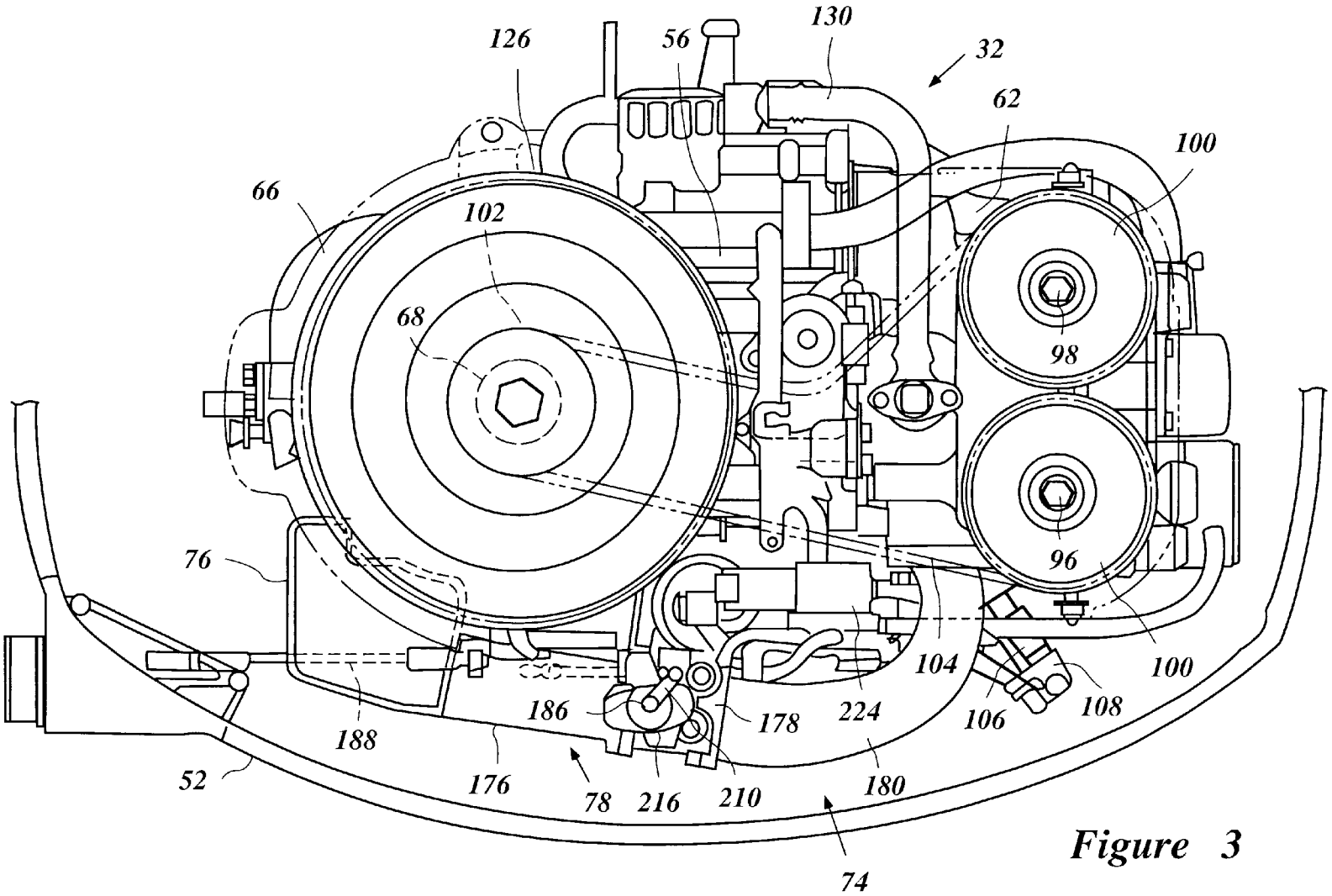
FIG. 3 is a top plan view of the outboard motor and engine of FIG. 2. The top cowling is detached and a half of the bottom cowling is omitted.

With reference to FIGS. 1–3, an outboard motor 30 includes an internal combustion engine 32 configured in accordance with a preferred embodiment of the present invention. Although the present invention is shown in the context of an engine for an outboard motor, various aspects and features of the present invention also can be employed with engines for other types of marine outboard drive units (e.g., a stern drive unit) and also, for example, for land vehicles.

The outboard motor 30 comprises a drive unit 34 and a bracket assembly 36. The bracket assembly 36 supports the drive unit 34 on a transom 38 of an associated watercraft 40 so as to place a marine propulsion device of the drive unit 34 in a submerged position with the watercraft 40 resting on the surface of a body of water. Although merely schematically shown in FIG. 1, the bracket assembly 36 comprises a swivel bracket, a clamping bracket, a steering shaft and a pivot pin 42.

The steering shaft extends through the swivel bracket and is affixed to the drive unit 34. The steering shaft is pivotally journaled for steering movement about a generally vertically extending steering axis within the swivel bracket. The clamping bracket includes a pair of bracket arms spaced apart from each other and affixed to the watercraft transom 38. The pivot pin 42 completes a hinge coupling between the swivel bracket and the clamping bracket. The pivot pin 42 extends through the bracket arms so that the clamping bracket supports the swivel bracket for pivotal movement about a generally horizontally extending tilt axis of the pivot pin 42.

Because these types of bracket assemblies are well known in the art, further description of them is not believed to be necessary to permit those skilled in the art to practice the invention.

As used through this description, the terms "forward," "forwardly" and "front" mean at or to the side where the bracket assembly 36 is located, and the terms "rear," "reverse," "backwardly" and "rearwardly" mean at or to the opposite side of the front side, unless indicated otherwise or otherwise readily apparent from the context use.

The drive unit 34 includes a power head 44, a driveshaft housing 46 and a lower unit 48. The power head 44 is disposed atop the drive unit 34 and includes the engine 32, a top protective cowling 50 and a bottom protective cowling 52 (see FIG. 2).

The engine 32 operates on a four-stroke combustion principle and powers a propulsion device. This type of engine is illustrated as an exemplary one. Other types of engines such as those having other cylinder configuration, having other number of cylinders and operating on other combustion principles (e.g., two-stroke crankcase combustion) are all applicable.

The engine 32 has a cylinder body 56 that defines four cylinder bores 58. The cylinder bores 58 are generally horizontally extending and are spaced generally vertically apart from each other. A piston 60 can reciprocate in each cylinder bore 58. A cylinder head assembly 62 is affixed to one end of the cylinder body 56 and defines four combustion chambers 64 with the pistons 60 and the cylinder bores 58. The other end of the cylinder body 56 is closed by a crankcase member 66 defining a crankcase chamber with the cylinder bores 58.

A crankshaft 68 extends generally vertically through the crankcase chamber. The crankshaft 68 is pivotally connected with the pistons 60 by connecting rods 70 and rotates with the reciprocal movement of the pistons 60. The crankcase member 66 is located at the forward-most end of the engine 32, then the cylinder body 56 and the cylinder head assembly 62 extend rearwardly from the crankcase member 66 one after the other.

The engine 32 includes an air induction system 74 and an exhaust system. The air induction system 74 supplies air charges to the combustion chambers 64. The induction system 74 comprises a plenum chamber 76 (see FIGS. 2 and 3), four main air intake passages 78 and four intake ports 80. The intake ports 80 are defined in the cylinder head assembly 62, and are opened and closed by the intake valves 82.

When each intake port 80 is opened, the corresponding air intake passage 78 communicates with the associated combustion chambers 64. The air induction system 74 will be described in greater detail below.

The exhaust system leads burnt charges or exhaust gases out from the combustion chambers 64 so as to discharge them outside of the outboard motor 30. Exhaust ports 86 are also defined in the cylinder head assembly 62, and are opened and closed by the exhaust valves 88. When the exhaust ports 86 are opened, the combustion chambers 64 communicate with an exhaust manifold 90 that gathers exhaust gases and guides them downstream of the exhaust system. The exhaust gases principally are discharged to the body of water surrounding the outboard motor 30 through exhaust passages formed in the driveshaft housing 46 and the lower unit 48 in a manner well known in the art.

An intake camshaft 96 and an exhaust camshaft 98 both extend generally vertically to activate the intake valves 82 and the exhaust valves 88, respectively. These camshafts 96, 98 have cam lobes thereon to push the intake valves 82 and the exhaust valves 88 at certain timings so as to open and close the respective ports 80, 86.

The camshafts 96, 98 are journaled on the cylinder head assembly 62 and are driven by the crankshaft 68. As best seen in FIG. 3, the respective camshafts 96, 98 have sprockets 100 affixed thereon, while the crankshaft 68 has a sprocket 102 affixed thereon. A cogged belt or chain 104 is wound around the sprockets 100, 102. With rotation of the crankshaft 68, the camshafts 96, 98 rotate accordingly.

In the illustrated embodiment, the engine 32 includes a fuel injection system; however, various aspects of the present invention can be used with engines using other types of charge formers, such as, for example, carburetors. The fuel injection system includes four fuel injectors 106 and fuel delivery conduits 108 including a fuel rail. A fuel supply tank (not shown) is placed in the hull of the associated watercraft 40. The fuel contained in the fuel supply tank is supplied to low pressure fuel pumps and a high pressure fuel pump both placed on the outboard motor 30 to be pressurized by them. The pressurized fuel is then delivered through the delivery conduits 108 to the fuel injectors 106. The fuel is sprayed into the intake ports 80 every compression stroke during each cycle at a proper timing and then enters the combustion chambers 64 with air when the intake valves 82 are opened. The injection timings are controlled by an ECU (Electronic Control Unit) 110, which is electronically operated, through a signal line 112. The ECU 110 will be described later in more detail.

The engine 32 further includes an ignition or firing system 114. The ignition system 114 includes spark plugs 116 having electrodes which are exposed into the respective combustion chambers 64 and spark to ignite an air/fuel charge at a proper timing every combustion cycle. The firing system 114 further includes an ignition coil 118 and an igniter 120, which are connected to the ECU 110 through a signal line 122 so that the firing timings are also controlled by the ECU 110. The ignition coil 118 is connected to the respective spark plugs 116 via a distributor. The firing system 114, however, can have multiple ignition coils for the respective cylinders instead of having the distributor. The ignition timing is advanced or retarded from an initial set timing in response to various engine running conditions. In general, advancing of the ignition timing results in an increase of the engine speed. Conversely, however, retarding of the timing brings in a decrease of the engine speed.

The air/fuel charge in each combustion chamber 64 is formed with the air supplied by the main air intake passage 78 and the fuel sprayed by the fuel injector 106. While the illustrated engine employs an indirect injection system that sprays the fuel into the air induction path, the engine can use a direct fuel injection system that sprays the fuel directly into the combustion chamber 64.

As seen in FIGS. 2 and 3, a flywheel assembly 126 is affixed atop the crankshaft 68. The flywheel assembly 126 includes a generator to supply electric power to the firing system 114, the ECU 110, a battery and other electrical equipment of the outboard motor 30 and the watercraft 40. A protective cover member 128 covers the flywheel assembly 126, the sprockets 100, 102 and the timing belt i 04 for protection of the operator or occupant of the watercraft 40 from such moving parts when the top cowling 50 is detached.

Additionally, the engine 32 has a cooling system that cools heated portions of the engine 32, such as, for example, the cylinder body 56 and the cylinder head assembly 62. In the illustrated embodiment, the engine 32 has at least a water jacket 129, which is provided in the cylinder body 56, as schematically shown in FIG. 1. A water discharge pipe 130 (see FIG. 3) is also provided for discharging the water, which has traveled in the cooling system, outside of the outboard motor 30.

The top and bottom cowlings 50, 52 generally completely surround the engine 32. The top cowling 50 is detachably affixed to the bottom cowling 52 so that the operator can access the engine 32 for maintenance or other purposes. As seen in FIG. 2, the top cowling 50 defines a pair of air intake compartments 132 with compartment members 134 and recesses 136 at both rear sides thereof. Each air intake compartment 132 has an air duct 138 that extends vertically in the compartment 132. The air intake compartments 132 communicate with a closed cavity defined by the protective cowlings 50, 52 through the air ducts 138.

As seen in the lower half view of FIG. 1, the driveshaft housing 46 depends from the power head 44 and supports a driveshaft 142 which is driven by the crankshaft 68 of the engine 32. The driveshaft 142 extends generally vertically through the driveshaft housing 46. The driveshaft housing 46 also defines internal passages which form portions of the exhaust system.

The lower unit 48 depends from the driveshaft housing 46 and supports a propeller shaft 146 which is driven by the driveshaft 142. The propeller shaft 146 extends generally horizontally through the lower unit 48. In the illustrated embodiment, the propulsion device includes a propeller 148 that is affixed to an outer end of the propeller shaft 146 and is driven thereby. A forward, neutral, reverse transmission device 150 is provided between the driveshaft 142 and the propeller shaft 146. The transmission device 150 couples together the two shafts 142, 146 which lie generally normal to each other (i.e., at a 90° shaft angle).

The transmission device 150 includes a bevel gear train and a clutch mechanism. The bevel gear train comprises a drive gear 152 connected to the driveshaft 142, and a forward bevel gear 154 and a reverse bevel gear 156 both disposed about the propeller shaft 146. The forward and reverse bevel gears 154, 156 are engaged with the drive gear 152 but are not initially drivingly connected to the impeller shaft. The respective bevel gears 154, 156 have fixed dog clutch teeth, while the propeller shaft 146 has moveable dog clutch teeth. The moveable dog clutch teeth are slideably supported on the propeller shaft 146 and can be moved by a shift mechanism or shift actuator 160.

The shift mechanism 160 includes a shift cam 162, a shift rod 164 and a shift cable 166. The shift rod 164 extends generally vertically through the driveshaft housing 46 and lower unit 48, while the shift cable 166 is disposed in the lower protective cowling 52. The shift cable 166 extends forwardly out from the lower cowling 52 and is connected to a shift lever box 168, which is remotely located near a steering handle in the associated watercraft 40. The shift lever box 168 is provided with a shift lever 170 so as to be operated by the operator to one of three positions, i.e., F, N and R positions, as shown in FIG. 1. The shift mechanism 160 is operable at an engine speed that is less than a certain engine speed. In the illustrated embodiment, this engine speed is 1500 rpm.

When the operator wants to move the watercraft 40 forwardly or backwardly, or stop the watercraft 40, he or she shifts the transmission device 150 to a forward, reverse or neutral position, respectively, using the shift lever 170. This operation can selectively engage the moveable dog clutch teeth on the propeller shaft 146 with the fixed dog clutch teeth on the forward bevel gear or the reverse bevel gear, and can move the movable dog clutch teeth out of engagement with the fixed clutch teeth on the forward or reversed bevel gear. If the propeller shaft 146 is coupled with the forward bevel gear 154 through that connection (forward position), the propeller 148 rotates in the forward direction to propel the watercraft 40 forwardly. If the propeller shaft 146 is coupled with the reverse bevel gear 156 (reverse position), the propeller 148 rotates in the reverse direction to propel the watercraft backwardly. If, however, the propeller shaft 146 is not coupled with any one of the bevel gears 154, 156 (neutral position), the propeller 148 does not rotate and the watercraft 40 is not driven.

The lower unit 48 also defines an internal passage that forms a discharge section of the exhaust system. At engine speed above idle, the majority of the exhaust gasses are discharged to the body of water surrounding the outboard motor 30 through the internal passage and finally through a hub 174 of the propeller 148 in a manner well known in the art.

Still with reference to FIGS. 1–3, the air induction system 74 will now be described in more detail. As seen in FIG. 3, the plenum chamber 76 in this embodiment is positioned on the port side of the crankcase member 66. The main air intake passages 78 extend rearwardly from the plenum chamber 76 along the port side surface of the cylinder body 56 and then curved toward the intake ports 80. The plenum chamber 76 has an inlet opening (not shown) on its front surface. The plenum chamber 76 functions as an intake silencer and/or a coordinator of air charges. The air intake passages 78 are actually defined by duct sections 176, which are uniformly formed with the plenum chamber 76, the throttle bodies 178 and the runners 180. The upper two throttle bodies 178 are unified with each other. The upper two runners 180 are uniformly formed with each other at their fore portions and then forked into two rear portions. The lower, two throttle bodies 178 and the runners 180 have the same construction as the upper two throttle bodies 178 and the runners 180.

The air intake passages 78 comprising these sections or members 176, 178, 180 extend generally horizontally along the respective cylinder bores 58 and are spaced generally vertically with each other. As indicated in FIG. 2, the air intake passages 78 are numbered as #1 through #4 from the top to the bottom to aid description.

The respective throttle bodies 178 support throttle elements (e.g., butterfly-type throttle valves) 184. In the illustrated embodiment, the throttle valves 184 are supported within the respective throttle bodies 178 for pivotal movement about axes of valve shafts extending generally vertically. The valve shafts are linked together to form a single valve shaft 186 that passes through all of the throttle bodies 178. The throttle valves 184 are operable by the operator through a throttle cable 188 and a non-linear control mechanism 190.

The non-linear control mechanism 190 includes a first lever 194 and a second lever 196 coupled to the first lever 194 by a cam connection. The first lever 194 is pivotally connected to the throttle cable 188 and pivotally connected to a first pin 198, which is affixed to the cylinder body 56. The first lever 194 has a cam slot 200 at the end opposite of the connection with the throttle cable 188. The second lever 196 is generally shaped as the letter "L" and is pivotally connected to a second pin 202, which is affixed to the crankcase member 66. The second lever 196 has a pin 204 that fits and slides within the cam slot 200. The other end of the second lever 196 is pivotally connected to a control rod 208. The control rod 208, in turn, is pivotally connected to a lever member 210 (FIG. 3). The lever member 210 is then connected to the throttle valve shaft 186 via a torsion spring 212 that urges the control rod 208 to a position shown in FIG. 2. At this position of the control rod 208, the throttle valve shaft 186 is in a closed position wherein almost no air charge can pass through the air intake passages 78.

When the throttle cable 188 is operated, the first lever 194 pivots counter-clockwise in FIG. 2 about the first pin 198. The second lever 196 then pivots about the second pin 202 in a clockwise direction. Since the pin 204 of the second lever 196 is fitted in the cam slot 200, the second lever 196 pivots with the pivotal movement of the first lever 194 in a nonlinear manner, i.e., in accordance with a relationship defined by the cam shape. Then, the second lever 196 pushes the control rod 208 against the biasing force of the torsion spring 212 to open the throttle valves 184. When the throttle cable 188 is released, the control rod 208 returns to the initial position under the biasing force of the spring 212 to close the throttle valves 184.

A throttle valve position sensor 216 is placed atop the throttle valve shaft 186. A signal from the position sensor 216 is sent to the ECU 110 through a signal line 218. This signal can be used by the ECU for fuel injection control, ignition control, engine speed control (including an idle speed control), and other various engine controls.

The air induction system 74 further includes an idle air supply passage or bypass passage 222 (FIG. 1) that bypasses the throttle valves 184. An idle air adjusting unit 224, which incorporates a throttle element, such as, for example, a butterfly-type valve, is provided in the idle passage 222.

The valve provided in the idle unit 224 and the foregoing throttle valves 184 are not limited to the butterfly-type valves and, for example, needle-type or gate-type valves are also applicable.

In the illustrated embodiment, the idle unit 224 is located between the cylinder body 56 and the main air intake passages 78, and is affixed to the #1 and #2 runners 180. This is advantageous because the heat in the cylinder body 56 does not directly conduct to the idle unit 224. An inlet portion 228 of the idle passage 222, which is shown in FIG. 1 and also schematically shown in phantom line in FIG. 2, connects the plenum chamber 76 to the idle unit 224. A pair of outlet portions 230 of the idle passage 222, which are flexible pipes made of rubber material, connect the idle unit 224 to bypass inlet ports, which are positioned at the #1 and #3 throttle bodies 178 downstream of the throttle valves 184.

Each inlet port also communicates with the other main passage 78. That is, the inlet port of the #1 throttle body 178 communicates with the #2 throttle body through a path formed within the common body of both the #1 and #2 throttle bodies 178. The inlet port of the #3 throttle body 178 communicates with the #4 throttle body 178 in the same manner.

An opening degree of the valve in the idle unit 224 is controlled by the ECU 110 through a signal line 232. An idle engine speed of the engine 32 in this illustrated embodiment is preferably set at 700 rpm. The maximum engine speed when the idle valve is fully opened is preferably set at 1400 rpm. The ECU 110 thus normally controls the idle valve to open less than the fully opened position so that the engine speed will not exceed the idle speed.

Air is introduced, at first, into the air intake compartments 132, as indicated by the arrow 234, and enters the cavity of the cowlings 50, 52 through the air ducts 138, as indicated by the arrows 236, 238. Then, the air flows down to the inlet opening of the plenum chamber 76, as indicated by the arrow 240, and is pulled into the plenum chamber 76. The plenum chamber 76 attenuates intake noise and delivers the air to the respective duct sections 176.

Under running conditions above idle, air charge amounts are controlled by the throttle valves 184 to meet requirements of the engine 32. The regulated volume of air then flows through the respective runners 180 and reaches the intake ports 80. As described above, the intake valves 82 are provided at these intake ports 80. Because the intake valves 82 are opened intermittently by the cam lobes of the intake camshaft 96, the air is pulled into the combustion chambers 64 while the pistons 60 moves toward bottom-dead-center and the intake valves 82 are opened.

Under the idle running condition, the throttle valves 184 are generally closed, although a very small opening degree is still ensured in this condition. Air, hence, flows to the idle unit 224 in the idle passage 222. The ECU 110 alters the opening degree of the valve in the idle unit 224 to adjust an amount of air passing through the idle passage 222 in response to fluctuations in the engine load and the air amount passing through the throttle valves 184. The idle air, as adjusted in the idle unit 224, then returns back to the main passages 78, i.e., to the runners 180, and is delivered to the combustion chambers 64.

The ECU 110 controls the engine operations including timings and duration of the fuel injection, ignition timings and valve opening degrees of the idle valve. The ECU 110 has various control maps or stored memory for these controls. In order to determine appropriate control indexes in the maps or to calculate them based upon the control indexes determined in the maps, various sensors other than the throttle valve position sensor 204 are provided for sensing engine conditions and other environmental conditions.

There is provided, associated with the crankshaft 68, a crankshaft angle position sensor 250 which, when measuring crankshaft angle versus time, outputs a crankshaft rotational speed signal or engine speed signal that is sent to the ECU 110 through a signal line 252.

An intake air pressure sensor 254 is provided that senses air pressure in one of the main air passages 78. The sensed signal is sent to the ECU 110 through a signal line 256. This signal can be used for determining an engine load.

An intake air temperature sensor 258 is provided that senses air temperature in one of the main air passages 78. The sensed signal is sent to the ECU 110 through a signal line 260. This signal can be used for adjusting the air pressure signal.

A water temperature sensor 262, which outputs a cooling water temperature signal to the ECU 110 through a signal line 264, is provided at the waterjacket 129.

A cylinder discrimination sensor 266 is also provided to sense a rotational angle of the exhaust camshaft 98 so as to discriminate a specific cylinder from other cylinders. The sensed signal is transmitted to the ECU 110 through a signal line 268.

Also, there is provided a shift position sensor 270 that sends a signal indicating a position (forward, neutral or reverse) of the shift rod 164 to the ECU 110 through a signal line 272.

A lever operational speed sensor 274 is provided to sense a rotational speed of the shift lever 170 and its signal is sent to the ECU 110 through a signal line 276.

A watercraft velocity sensor 278 is further provided at the lowermost portion of the transom 38 and sends a velocity signal to the ECU 110 through a signal line 280.

Various physical structures of these sensors are well known and any one of such conventional sensors are applicable. Thus, further descriptions on them are not believed to be necessary to understand and practice the present engine control strategies.

As noted above, a relatively large amount of air can under some circumstances be continuously supplied to the combustion chambers 56 even though the throttle valves 184 are fully closed. Under this condition, the engine speed exceeds a desired idle speed (e.g., 700 rpm in this embodiment) and the engine 32 operates at a speed greater than this speed all the time unless the operator stops the engine. The same situation can also occur if the ignition timing is inadvertently advanced.

As also noted above, if the engine speed exceeds the idle speed, for example, the shift operation on the transmission device 150 will be difficult because the transmission device 150 employs the dog clutch mechanism. In the illustrated embodiment, as noted above, if the engine speed is less than 1500 rpm, the operator may be able to shift, but with great difficulty. If, however, the engine speed exceeds 1500 rpm, this operation will be extremely difficult.

In the illustrated embodiment, therefore, if the abnormal situation occurs, the ECU 110 attempts to slow down the engine speed through various modes of engine control.

Figure 4:
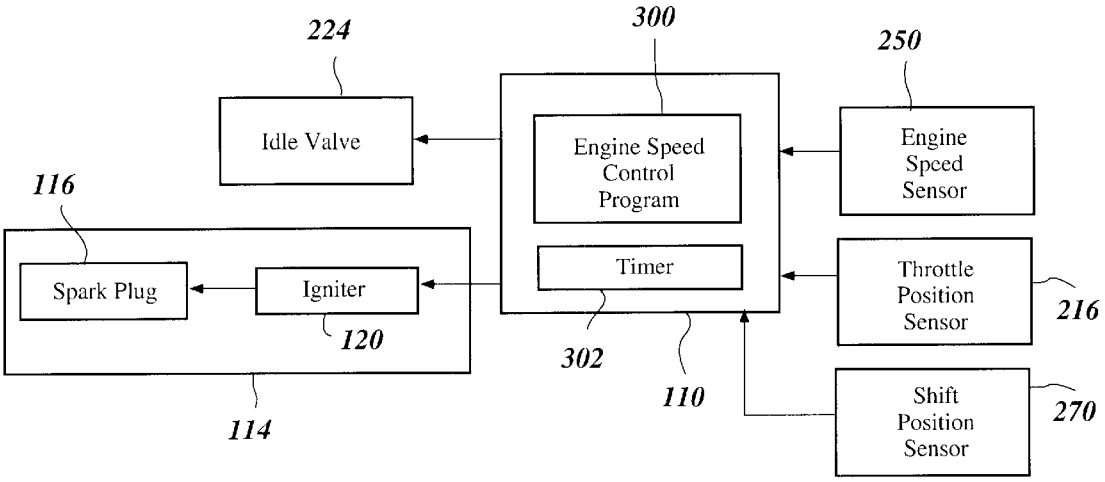
FIG. 4 is a block diagram showing a control device of the engine to control engine speed.
Figure 5:
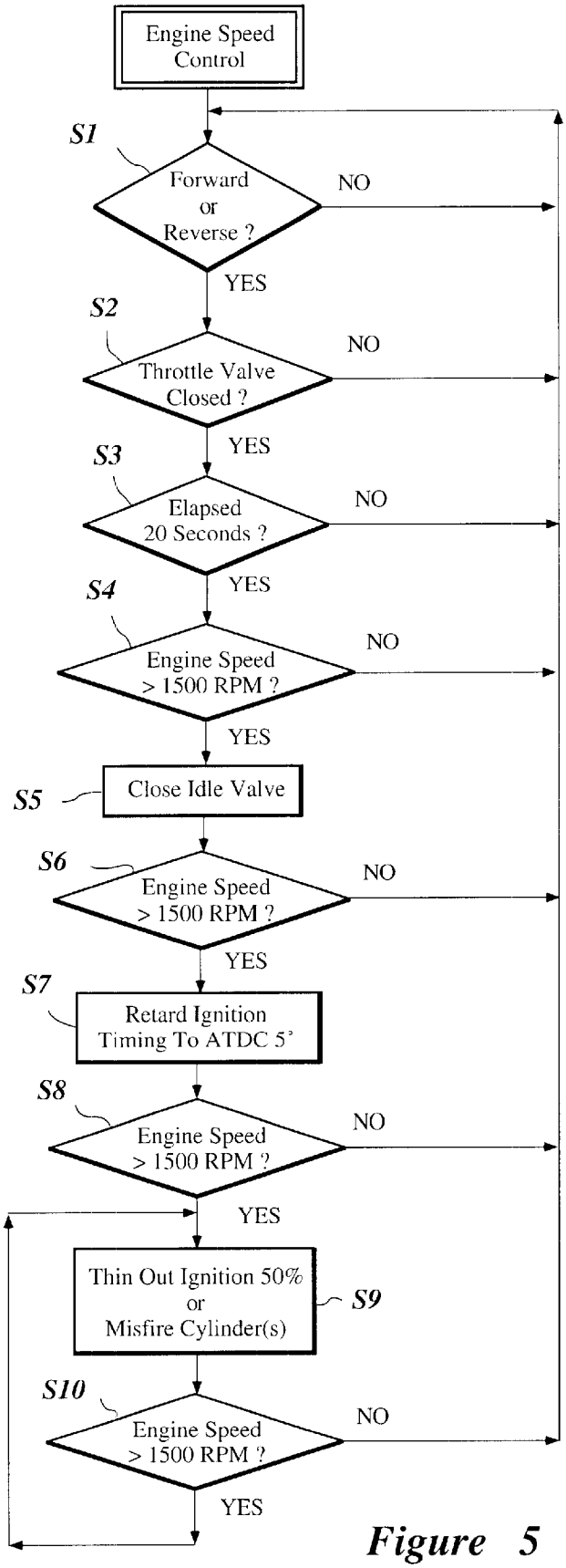
FIG. 5 is a flowchart showing a control routine of the control device for engine speed control.

With reference still to FIGS. 1–3, and additional reference to FIGS. 4 and 5, an engine speed control by the ECU 110 will be described below. A program or control measures 300 are provided to ease the shifting operation under such abnormal engine running condition. That is, the control is provided so that the operator can easily bring the transmission device 150 out of the forward or reverse position toward the neutral position. For this control, the ECU 110 first needs to recognize whether the transmission device 150 is in the forward, reverse or neutral position. The shift position sensor 270 provides this information. The ECU 110 should also know whether the throttle valves 184 are closed. The throttle valve position sensor 216 provides this information. Further, the ECU 110 needs to recognize whether the engine speed exceeds a preset speed, e.g., 1500 rpm. The crankshaft angle position sensor 250 provides this information.

Time elapse information is also necessary for the ECU 110 to determine whether the throttle valves 184 have been closed for a preset time period. In the illustrated embodiment, the time period is set at 20 seconds. In other embodiments, this time period can range from 5 to 30 seconds. The ECU 110 preferably obtains the time information by its own internal timer or pulse counter 302 that counts clock pulses.

In the illustrated embodiment, if the engine speed still exceeds the preset speed after the preset time under the condition that the throttle valves 184 are closed, the ECU 110 starts controlling the idle valve in the idle unit 224 and the igniter 120 in the ignition system 114 so as to slow down the engine speed. The engine speed control in this embodiment will be achieved in accordance with the control routine shown in FIG. 5.

The program starts and proceeds to step S1 to determine whether the transmission device 150 is in the forward or reverse position based upon the signal sent from the shift position sensor 270. If this is positive, i.e., if the transmission device 150 is in one of these positions, the program goes to step S2. If it is negative, i.e., if the transmission device 150 is in the neutral position, the program returns to step S1 and repeats it again.

At step S2, the program determines whether the throttle valves 184 are closed based upon the signal sent from the throttle valve position sensor 216. If this is positive, the program goes to step S3. If, however, it is negative, the program returns to step S1 and repeats it.

At step S3, the program determines whether a preset time has elapsed by its own timer 302. As noted above, the preset time is set at 20 seconds in this embodiment. If this is positive, the program goes to step S4. If it is negative, the program returns to step SI and repeats it again.

At step S4, the program determines whether the engine speed exceeds a preset speed, e.g., 1500 rpm, based upon the signal sent from the crankshaft angle position sensor 250. If this is affirmative, the program goes to step S5. If it is negative, however, the program goes back to step S1 and repeats it again.

At step S5, the ECU 110 outputs a control signal to the idle unit 224 through the line 232 so as to close the idle valve. After this operation, the program goes to step S6 to determine whether the engine speed is still greater than the preset speed. If this is positive, the program goes to step S7. If it is negative, then the program returns to step S1 and repeats it again.

At step S7, the ECU 110 outputs a control signal to the igniter 120 through the line 122 so as to retard an ignition timing from an initial set timing. In the illustrated embodiment, the ignition timing at idle is set at 5 degrees ATDC (after top-dead-center). This approach may be necessary in the event that the idle set timing is automatically advanced to a timing around TDC. The ECU 110 hence retards the advanced ignition timing to the initial idle timing, e.g., 5 degrees ATDC.

After completion of this control, the program goes to step S8 to determine again whether the engine speed still exceeds the preset speed. If this is positive, the program goes to step S9. If, however, it is negative, the program goes back to step S1 so as to repeat it.

At step S9, the ECU 110 outputs a control signal to the igniter 120 through the control line 122 so as to thin out the number of ignition signals for certain percentages. This percentage is set as 50% in this embodiment, i.e., half of the ignition signals are skipped.

Alternatively, the ECU 110 outputs a control signal to the igniter 120 so that a certain spark plug 116 at one of the combustion chambers 64 misfires. The ECU 110, alternatively further outputs a control signal to the igniter 120 so that all of the spark plugs 116 misfire at once or at random times. By these misfiring controls, the cylinder(s) will fail to burn the air/fuel mixture in the respective combustion chamber(s) 64. The fuel injection system also is preferably controlled not to spray fuel to this specific combustion chamber 64 or combustion chambers 64 to inhibit an unburnt fuel charge from being discharged to the atmosphere.

After the foregoing thinning out control or misfiring control completes, the program goes to step S10 to determine whether the engine speed exceeds the predetermined speed. If this is affirmative, the program returns to step S9 and repeats it. If it is negative, the program again goes back to step S1 to repeat it.

It is advantageous to combine different kinds of controls because some of the controls may be right to surely slow down the engine speed. It should be noted, however, that combinations and sequences are not limited to the control routine shown in FIG. 5. For example, step S7 can be performed ahead of step S5. Also, for example, in some modes of operation, some of the steps S5, S7 and S9 can be omitted or duplicated.

The shift operation on the transmission device 150, therefore, can be easily done every time by the slow down control of the engine speed. It should be noted that the shift position signal is not necessarily involved in the engine speed control because the ECU 110 must correct such an abnormal situation when engine speed exceeds the preset speed regardless of the drive condition of the transmission device 150.

The engine speed control can add a reduction of a fuel amount or replace one of the foregoing control items with fuel reduction.

In addition, engine speed information can be obtained by sensing other than the rotational speed of the crankshaft. For example, a rotational speed of the camshafts can be sensed to determine indirectly the engine's speed.

In the foregoing embodiment, the preset engine speed is set at 1500 rpm. This speed, however, can be set at other than this speed. For example, but without limitation, it can be selected in a range of engine speed 700 to 1500 rpm.

The foregoing description is that of certain features, aspects and advantages of the present invention to which various changes and modifications may be made without departing from the spirit and scope of the present invention. Moreover, a engine may not feature all objects and advantages discussed above to use certain features, aspects and advantages of the present invention. Thus, for example, those skilled in the art will recognize that the invention may be embodied or carried out in a manner that achieves or optimizes one advantage or group of advantages as taught herein without necessarily achieving other objects or advantages as may be taught or suggested herein. Moreover, many of the steps of the routines described above can be performed in various orders, as will be well understood by one skilled in the art from the above description, while still carrying out one or more objects or advantages of the present invention. The present invention, therefore, should only be defined by the appended claims.

What is claimed is:

1. An internal combustion engine comprising a cylinder body defining at least one cylinder bore in which a piston reciprocates to rotate a crankshaft, a cylinder head affixed to an end of the cylinder body and defining a combustion chamber with the cylinder bore and the piston, an air induction system arranged to introduce air to the combustion chamber, the air induction system including a main passage, a throttle valve movable within the main passage between an open position and a closed position to regulate air flow through the main passage, an idle passage bypassing the throttle valve, and an idle valve movable within the idle passage between an open position and a closed position to regulate air flow through the idle passage, a fuel supply system arranged to supply fuel to the combustion chamber, an ignition system arranged to fire an air/fuel charge within the combustion chamber, a throttle valve position sensor arranged to sense that the throttle valve is generally placed in the closed position, an engine speed sensor arranged to sense a rotational speed of the crankshaft, and a control device connected with the sensors, the idle valve and the ignition system, the control device being configured to practice one of slow down controls comprising bringing the idle valve to the closed position, retarding ignitions by the ignition system and thinning out a certain number of ignitions by the ignition system to slow down the rotational speed of the crankshaft based upon a throttle position signal from the throttle valve position sensor and an engine speed signal from the engine speed sensor when the throttle position signal indicates that the throttle valve is generally placed in the closed position and the speed signal indicates that the rotational speed of the crankshaft exceeds a preset speed, and the control device being further configured to practice one of the remaining slow down controls when the speed signal still indicates that the rotational speed of the crankshaft exceeds the preset speed.

2. The internal combustion engine as set forth in claim 1, wherein the control device includes a timer, and the control device delays an initiation timing of the first slow down control for a preset time after the engine speed has exceeded the preset speed.

3. The engine as set forth in claim 1, wherein the control device being still further configured to practice the rest of the slow down controls when the speed signal still yet indicates that the rotational speed of the crankshaft exceeds the preset speed.

4. The engine as set forth in claim 1, wherein the control device does not practice each one of the slow down controls without determining whether the rotational speed of the crankshaft exceeds the preset speed.

5. The engine as set forth in claim 4, wherein the control device compares with substantially the same preset speed at every determination whether the rotational speed of the crankshaft exceeds the preset speed.

6. A marine propulsion unit comprising an internal combustion engine, a transmission device, a propulsion device for propelling the propulsion unit, the transmission device being arranged to transmit engine power from the engine to the propulsion device, a shift mechanism arranged to shift the transmission device among the forward, neutral and reverse positions, a shift position sensor arranged to sense that the transmission device is in either the forward position or the reverse position, the internal combustion engine including a cylinder body defining at least one cylinder bore in which a piston reciprocates to rotate a crankshaft, which is coupled to the transmission, a cylinder head affixed to an end of the cylinder body and defining a combustion chamber with the cylinder bore and the piston, an air induction system arranged to introduce air to the combustion chamber, the air induction system including a throttle valve movable between an open position and a closed position to regulate air flow through the air induction system, a throttle valve position sensor arranged to sense that the throttle valve is generally placed in the closed position, an engine speed sensor arranged to sense a rotational speed of the crankshaft, and a control device including a timer that counts a preset time, the control device being configured to practice a slow down control to slow down the rotational speed of the crankshaft based upon a shift position signal from the shift position sensor, a throttle position signal from the throttle valve position sensor and a speed signal from the engine speed sensor when the shift position signal indicates that the propulsion device is in either the forward position or the reverse position, the throttle position signal indicates that the throttle valve is generally in the closed position and the speed signal indicates that the engine speed exceeds a preset speed, and the control device being further configured to suspend the slowdown control for the preset time after determining that the throttle valve is generally placed in the closed position.

7. A method of controlling an internal combustion engine having a crankshaft and an air induction system including a throttle valve, comprising sensing a position of the throttle valve, sensing a rotational speed of the crankshaft, and attempting to slow down the rotational speed of the crankshaft if the throttle valve is generally placed at a closed position and the rotational speed exceeds a preset speed, further sensing the rotational speed of the crankshaft, and further attempting to slow down the rotational speed of the crankshaft if the rotational speed of the crankshaft still exceeds the preset speed at the further sensing.

8. A method of controlling an internal combustion engine for a marine propulsion unit, the marine propulsion unit including a transmission device and a shift mechanism arranged to shift the transmission device among the forward, reverse and neutral positions, the engine including a crankshaft and an air induction system having a throttle valve, the method comprising sensing a position of the transmission device, determining whether the transmission device is in either the forward position or the reverse position, sensing a position of the throttle valve, determining whether the throttle valve is generally placed in a closed position, counting a preset time if the throttle valve is generally placed in the closed position to suspend proceeding further for the preset time, sensing a rotational speed of the crankshaft, determining whether the rotational speed of the crankshaft exceeds a preset speed, and slowing down the rotational speed of the crankshaft if the transmission device is in either the forward position or the reverse position, the throttle valve is generally placed in a closed position and the rotational speed exceeds the preset speed.

9. An internal combustion engine comprising a cylinder body defining a plurality of cylinder bores in which pistons reciprocates to rotate a crankshaft, a cylinder head affixed to an end of the cylinder body and defining a plurality of combustion chambers with the cylinder bores and the pistons, an air induction system arranged to introduce air to the combustion chambers, the air induction system including a main passage, at least one throttle valve movable between an open position and a closed position to regulate air flow through the main passage, an idle passage bypassing the throttle valve, and an idle valve movable within the idle passage between an open position and a closed position to regulate air flow through the idle passage, a fuel supply system arranged to supply fuel to the combustion chambers, an ignition system arranged to fire air/fuel charges within the combustion chambers, a throttle valve position sensor arranged to sense that the throttle valve is generally placed in the closed position, an engine speed sensor arranged to sense a rotational speed of the crankshaft, and a control device connected with the sensors, the idle valve and the ignition system, the control device being configured to practice one of slow down controls comprising bringing the idle valve to the closed position, retarding a firing timing of the ignition system and disabling the ignition system from firing some of the combustion chambers to slow down the rotational speed of the crankshaft based upon a throttle position signal from the throttle valve position sensor and an engine speed signal from the engine speed sensor when the throttle position signal indicates that the throttle valve is generally placed in the closed position and the speed signal indicates that the rotational speed of the crankshaft exceeds a preset speed, and the control device being further configured to practice one of the remaining slow down controls when the speed signal still indicates that the rotational speed of the crankshaft exceeds the preset speed.

10. An internal combustion engine comprising a cylinder body defining at least one cylinder bore in which a piston reciprocates to rotate a crankshaft, a cylinder head affixed to an end of the cylinder body and defining a combustion chamber with the cylinder bore and the piston, an air induction system arranged to introduce air to the combustion chamber, the air induction system including a throttle valve movable between an open position and a closed position to regulate air flow through the air induction system, a throttle valve position sensor arranged to sense that the throttle valve is generally placed at the closed position, an engine speed sensor arranged to sense a rotational speed of the crankshaft, and a control device connected at least to the sensors, the control device being configured to practice a first slow down control to slow down the rotational speed of the crankshaft based upon a throttle position signal from the throttle valve position sensor and an engine speed signal from the engine speed sensor when the throttle position signal indicates that the throttle valve is generally placed in the closed position and the speed signal indicates that the rotational speed of the crankshaft exceeds a preset speed, the control device being further configured to determine whether the rotation speed of the crankshaft still exceeds the preset speed after practicing the first slow down control, and the control device being still further configured to practice a second slow down control when determining that the rotational speed of the crankshaft still exceeds the preset speed.

11. The marine propulsion unit as set forth in claim 6, wherein the transmission device includes a clutch mechanism having dog clutch elements.

12. The method as set forth in claim 7 additionally comprising suspending the first attempt of the slow down for a preset time after the rotational speed of the crankshaft has exceeded the preset speed.

13. The method as set forth in claim 7, wherein the air induction system includes an idle valve disposed in an idle passage bypassing the throttle valve, and either the first attempt or the second attempt includes closing the idle valve.

14. The method as set forth in claim 7, wherein either the first attempt or the second attempt includes retarding ignitions.

15. The method as set forth in claim 7, wherein either the first attempt or the second attempt includes thinning out a certain number of ignitions.

16. The method as set forth in claim 7, wherein the engine has a plurality of combustion chambers, and either the first attempt or the second attempt includes disabling ignitions at some of the combustion chambers.

17. The method as set forth in claim 7, wherein the air induction system includes an idle valve disposed in an idle passage bypassing the throttle valve, and the first and second attempts include at least two actions selected from retarding ignitions, thinning out a certain number of ignitions, and closing the idle valve.

18. The method as set forth in claim 17, wherein the engine has a plurality of combustion chambers, and the actions for the first and second attempts additionally includes disabling ignitions at some of the combustion chambers.

19. The method as set forth in claim 7, wherein the engine has a plurality of combustion chambers, and the first and second attempts include at least two actions selected from retarding ignitions, thinning out a certain number of ignitions and disabling ignitions at some of the combustion chambers.

20. The method as set forth in claim 19, wherein the air induction system includes an idle valve disposed in an idle passage bypassing the throttle valve, and the actions for the first and second attempts additionally includes closing the idle valve.

21. The method as set forth in claim 7, wherein the engine has a plurality of combustion chambers, the air induction system includes an idle valve disposed in an idle passage bypassing the throttle valve, and the first and second attempts include at least two actions selected from retarding ignitions, thinning out a certain number of ignitions, disabling ignitions at some of the combustion chambers and closing the idle valve.

22. The internal combustion engine as set forth in claim 9, wherein the control device includes a timer, and the control device delays an initiation timing of the first slow down control for a preset time after the engine speed has exceeded the preset speed.

23. The engine as set forth in claim 9, wherein the control device does not practice each one of the slow down controls without determining whether the rotational speed of the crankshaft exceeds the preset speed.

24. The engine as set forth in claim 6, wherein the control device has a plurality of control modes as the slow down control, the control device practices one of the control modes to slow down the rotational speed of the crankshaft, and the control device further practice another one of the control modes when the speed signal still indicates that the rotational speed of the crankshaft exceeds the preset speed.

25. The engine as set forth in claim 24, wherein the control device does not practice each one of the control modes without determining whether the rotational speed of the crankshaft exceeds the preset speed.

26. The engine as set forth in claim 24, wherein the control device compares with substantially the same preset speed at every determination whether the rotational speed of the crankshaft exceeds the preset speed.

27. The engine as set forth in claim 24, additionally comprising a fuel supply system arranged to supply fuel to the combustion chamber, and an ignition system arranged to fire an air/fuel charge within the combustion chamber, wherein the air induction system includes a main passage in which the throttle valve moves, an idle passage bypassing the throttle valve, and an idle valve movable within the idle passage between an open position and a closed position, the control modes includes bringing the idle valve to the closed position, retarding ignitions by the ignition system, and thinning out a certain number of ignitions by the ignition system.

28. The engine as set forth in claim 24, additionally comprising a plurality of the cylinder bores and the pistons together defining a plurality of the combustion chambers, a fuel supply system arranged to supply fuel to the combustion chambers, and an ignition system arranged to fire air/fuel charges within the combustion chambers, the air induction system including a main passage in which the throttle valve moves, an idle passage bypassing the throttle valve, an idle valve movable within the idle passage between an open position and a closed position to regulate air flow through the idle passage, the control modes including bringing the idle valve to the closed position, retarding ignitions, and disabling ignitions at some of the combustion chambers.

29. The engine as set forth in claim 6, wherein the preset speed substantially is a rotational speed of the crankshaft which is normally obtained when the throttle valve is generally placed in the closed position and the preset time has elapsed thereafter.

30. The method as set forth in claim 7, wherein the second attempt of the slow down includes an action different from an action included in the first attempt of the slow down.

31. The method as set forth in claim 30, wherein the air induction system includes an idle valve disposed in an idle passage bypassing the throttle valve, and either the action of the first attempt or the action of the second attempt includes closing the idle valve.

32. The method as set forth in claim 30, wherein at least one of the actions of the first and second attempts includes either retarding ignitions or thinning out a certain number of the ignitions.

33. The method as set forth in claim 30, wherein the engine has a plurality of combustion chambers, and either the action of the first attempt or the action of the second attempt includes disabling ignitions at some of the combustion chambers.

34. The method as set forth in claim 8, additionally comprising determining whether the rotational speed of the crankshaft still exceeds the preset speed, and further slowing down the rotational speed of the crankshaft if the rotational speed of the crankshaft still exceeds the preset speed.

35. The method as set forth in claim 34, wherein the first and second slow down controls include different actions from each other.

36. The method as set forth in claim 8, wherein the preset speed is substantially a rotational speed of the crankshaft which is normally obtained when the throttle valve is generally placed in the closed position and the preset time has elapsed thereafter.

37. The engine as set forth in claim 10, wherein the control device includes a timer, and the control device suspends the first slow down control for a preset time after the engine speed has exceeded the preset speed.

38. The engine as set forth in claim 10, wherein the control device practices the second slow down control with an action which is different from an action that the first slow down control employs.

* * * * *